United States Patent [19]

Best et al.

[11] Patent Number: 4,906,978

[45] Date of Patent: Mar. 6, 1990

[54] OPTICAL SMOKE DETECTOR

[75] Inventors: James A. Best, Netcong; Irving L. Ellner, Hopatcong, both of N.J.

[73] Assignee: Cerberus AG, Switzerland

[21] Appl. No.: 946,468

[22] Filed: Dec. 24, 1986

[51] Int. Cl.[4] ..... G08B 17/10

[52] U.S. Cl. ..... 340/630; 250/574; 356/439

[58] Field of Search ..... 340/630, 628, 515; 250/573–575, 578; 356/438, 439, 337, 338, 341–343

[56] References Cited

U.S. PATENT DOCUMENTS

| | | | |
|---|---|---|---|
| 4,121,110 | 10/1978 | Solomon | 250/574 |
| 4,232,307 | 11/1980 | Marsocci | 340/630 |
| 4,266,219 | 5/1981 | Foster et al. | 340/630 |
| 4,269,510 | 5/1981 | Horvath | 340/630 |
| 4,488,049 | 12/1984 | Marsocci | 340/630 |

*Primary Examiner*—Joseph A. Orsino
*Assistant Examiner*—Jill D. Jackson
*Attorney, Agent, or Firm*—Brumbaugh, Graves, Donohue & Raymond

[57] ABSTRACT

A focused beam of light from a light source is directed into a closed smoke chamber, having inlets for admitting smoke particles, toward a reflector which reflects and refocuses the beam back into the light source, the direct beam and the reflected beam passing through a test zone within the chamber. In the event that smoke particles enter the test zone, the direct and reflected beams strike and bounce off of those particles to produce scattered radiation that will be picked up and detected by a light responsive sensor to generate an alarm signal. By closely controlling, rather than baffling the light, optimum operation is obtained, efficiency is enhanced and false alarms are minimized. Additionally, to prevent any stray light from bouncing off of undesired dirt and dust in the chamber and being received by the light sensor, resulting in a false alarm, surfaces of the chamber are provided with parallel grooves for accumulating that dirt and dust, and the light sensor field of view is focused on an attenuating light trap. Stray light impinging on the grooved surfaces becomes attenuated and absorbed so there will be no reflections, and light entering the light trap is reduced to a negligible level.

20 Claims, 2 Drawing Sheets

OPTICAL SMOKE DETECTOR

BACKGROUND OF THE INVENTION

This invention relates to an optical or photoelectric smoke detector of the Tyndall type having increased efficiency and reliability.

In a Tyndall or light scatter type optical smoke detector smoke particles are admitted into a closed smoke chamber, while outside ambient light is precluded from the chamber. A light beam, projected into a test zone of the chamber, will strike and bounce off of smoke particles in the test zone to produce scattered or diffused light which is then detected by a photo or light responsive sensor to indicate the presence of an alarm condition. In the absence of smoke particles the light responsive sensor is optically shielded from the light source so that little or no stray or reflected light shines on the light sensor, thereby avoiding false alarms. In practice this has been difficult. In the past, various arrangements have been employed for baffling, absorbing and attenuating the light so that the light sensor responds only to scattered or diffused light reflected off of smoke particles and not to any direct light from the source or to any light reflected off of the chamber surfaces. The difficulty of restricting the light received by the sensor to scattered light bouncing off of the smoke particles is substantially increased when the optical smoke detector is located in an environment where undesired dust and dirt are likely to enter the chamber over a period of time and accumulate on the chamber surfaces. Even by making the surfaces black, light from the light source may reflect off of the dust and dirt on the surfaces and be received by the light sensor, causing the sensor to initiate the development of a false alarm signal.

The optical smoke detector of the present invention represents a significant improvement over prior scatter type detectors in that a unique optical arrangement is provided to precisely control the light in the chamber to obtain improved performance and increased efficiency. Moreover, the smoke detector is particularly reliable when subjected to undesired dust and dirt, since the operation of the smoke detector will be effectively immune to the accumulation of dust and dirt within the chamber.

SUMMARY OF THE INVENTION

The optical smoke detector of the invention comprises a hollow cylindrical body having generally flat and parallel top and bottom spaced-apart portions and an intermediate generally circular side wall portion, the body defining a closed smoke chamber having a plurality of inlets to allow the ingress and egress of smoke particles. Radiation emitting means, such as an infrared light source, is mounted in the side wall portion of the cylindrical body to project a direct and tightly focused beam of light into a test zone within the chamber. There is a reflector, mounted in the side wall portion directly opposite to and facing the radiation emitting means, for reflecting and refocusing the light beam back through the test zone and to the emitting means. The direct and reflected beams strike and bounce off of any smoke particles in that test zone to produce scattered radiation. Radiation sensing means, such as an infrared light sensor, is mounted in the side wall portion of the cylindrical body to detect the scattered radiation from the smoke particles to facilitate the signalling of an alarm condition.

In accordance with an aspect of the invention, at least one of the surfaces of the smoke chamber is shaped to provide a series of parallel grooves for accumulating undesired dirt and dust in the groove crevices, and for minimizing the reflection of light off of that dirt and dust and toward the radiation sensing means, thereby to preclude false alarms.

DESCRIPTION OF THE DRAWINGS

The features of the invention which are believed to be novel are set forth with particularity in the appended claims. The invention may best be understood, however, by reference to the following description in conjunction with the accompanying drawings in which like reference numbers identify like elements, and in which:

DETAILED DESCRIPTION OF THE INVENTION

Figure 1:
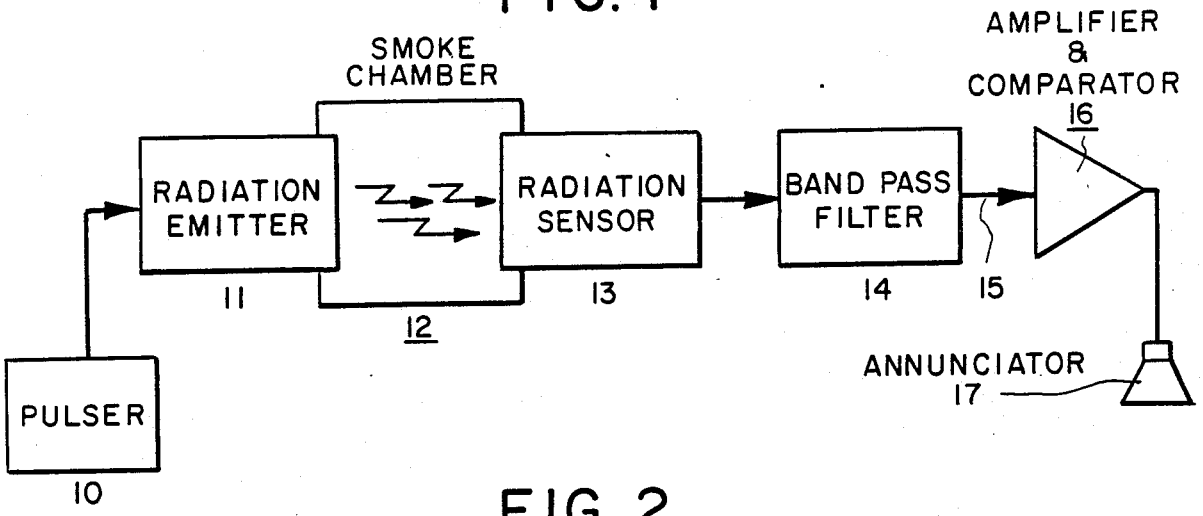
FIG. 1 is a block diagram of the complete optical smoke detector of the invention, including the detector's electrical components.
Figure 2:
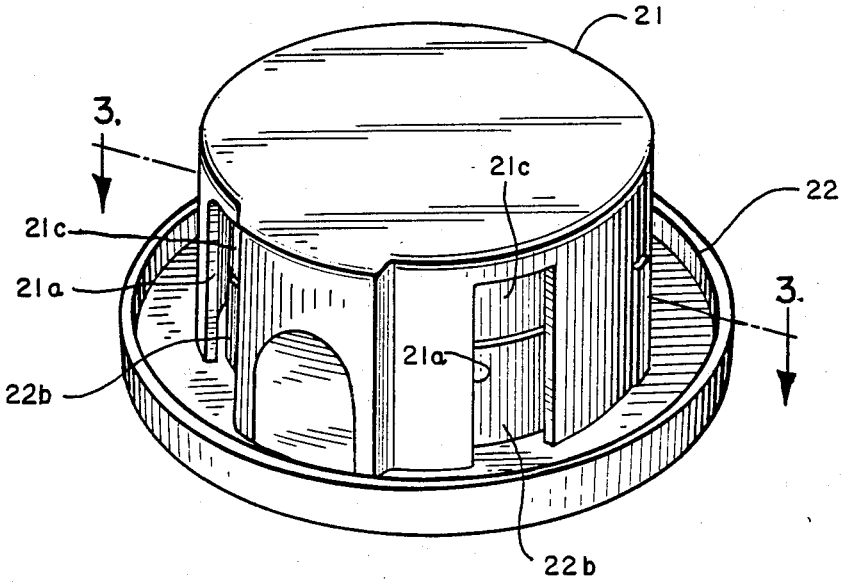
FIG. 2 is a perspective view of the assembled smoke detector minus most of the electrical circuitry.
Figure 5:
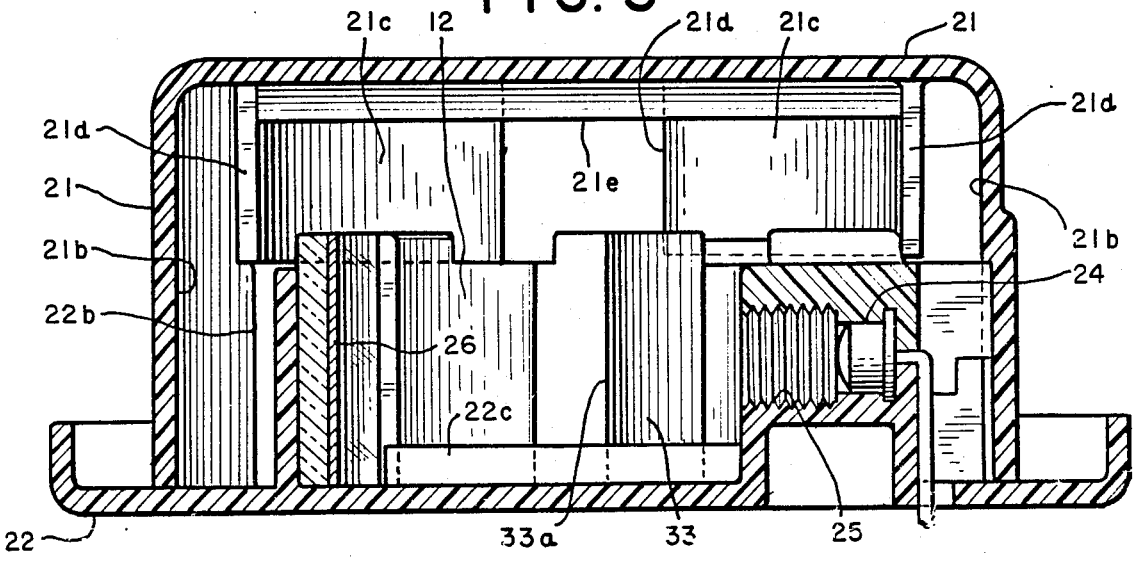
FIG. 5 is a sectional view taken along the plane of section line 5—5 in FIG. 3.
Figure 3:
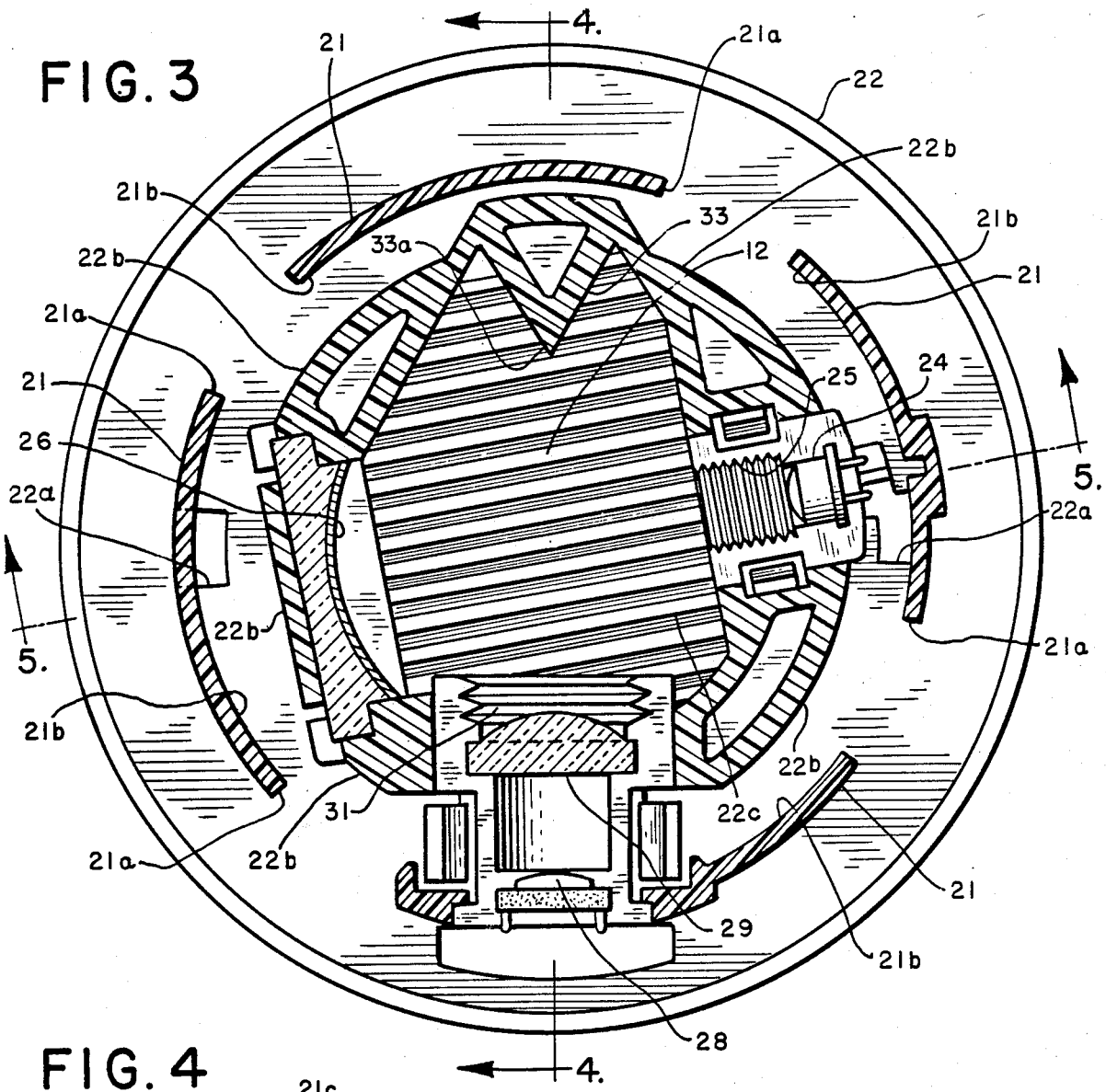
FIG. 3 is a sectional view taken along the plane of section line 3—3 in FIG. 2.
Figure 4:
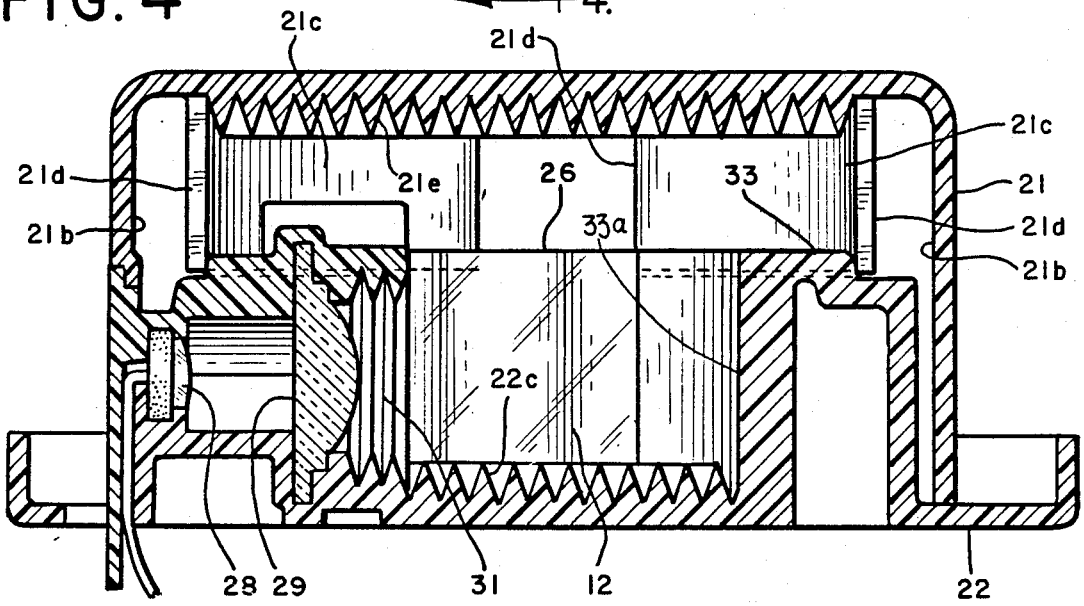
FIG. 4 is a sectional view taken along the plane of section line 4—4 in FIG. 3.

Turning now to FIG. 1, pulser 10, which can be a conventional oscillator, applies signals to energize a radiation emitting means 11, which may be an infrared light source. Each time the emitter is energized, a direct beam of light is projected into a test zone of smoke chamber 12 which is a closed chamber but has inlets to allow the ingress and egress of smoke particles. In a manner to be explained, the direct beam, plus a reflection of that beam which essentially coincides with the direct beam, will strike and bounce off of any smoke particles in the test zone to produce scattered or diffused radiation which impinges on and is detected by radiation sensing means 13, which, of course, will take the form of an infrared light sensor if emitter 11 is an infrared light source. Sensor 13 generates a signal representing the sensed radiation and this signal is through a band pass filter 14 to minimize spurious triggering by extraneous noise in the vicinity or area where the smoke detector system is located. The resultant signal from filter 14 is passed over line 15 to an amplifier and comparator circuit 16. If the amplitude of the signal on line 15 exceeds a reference threshold level as set by the comparator, which threshold level represents a fire alarm condition, circuit 16 supplies an actuating signal to annunciator 17 to provide an alarm or to effect some other function. Although shown in FIGURE 1 in the form normally representing a loudspeaker, those skilled in the art will appreciate that the annunciator could be a visible indicator such as a lamp, a loudspeaker, a vibrating unit to provide a sensory input to a person not having sight or hearing capability, or some other suitable indicator or function-producing unit.

Referring now to FIGS. 2–5, the smoke detector has a cylindrical, cup-shaped plastic part 21 having a pair of finger extensions with detents (not shown) that snap into, and are held by, respective ones of a pair of apertures **22*a* (see FIG. 3) in a base plastic part 22, part 21** thereby effectively covering part 22 and the components attached to part 22. Preferably, parts 21 and 22 are made of the same plastic material, such as black Noryl plastic which is available from General Electric Company. The plastic affords sufficient flexibility so that cover part 21 may be easily removed from part 22 by slightly squeezing part 21, approximately along the section line 5—5 in FIG. 3, and then pulling the parts away from each other. When the parts are snapped together, however, they are securely connected. In effect, plastic parts 21 and 22 together form a hollow cylindrical body having generally flat and parallel top and bottom spaced-apart portions and an intermediate generally circular side wall portion.

For convenience of illustration, cover part 21 is shown above or on top of base part 22. Actually, when the smoke detector is mounted in an area where smoke particles are to be monitored, base part 22 would usually be attached to the ceiling and part 21 would hang down or depend from part 22. Of course, such an orientation permits the cover 21 to be readily removed for inspection and/or cleaning of the internal components. Hence, in the normal use of the smoke detector, cap or cover 21 would be considered the bottom portion of the cylindrical body 21, 22, while base 22 would be the top portion.

The smoke chamber 12 has an irregular shape and is formed and defined by both parts 21 and 22. The top and bottom surfaces of chamber 12 arc generally flat and parallel, except for V-shaped grooves to be described later, whereas the walls of the chamber between the flat surfaces are irregularly shaped, as best seen in the plan view of chamber 12 in FIG. 3. Cover 21 has four cutaway portions **21*a* (see FIGS. 2 and 3) which permit the smoke particles to enter an annular shaped space or passage defined by the internal surfaces 21*b* of cover 21, the outer surfaces 22*b* of base 22, and the outer surfaces of four arcuate shaped wall segments 21*c* which depend from but are integral with the flat portion of cover 21. The annular shaped space or passage communicates with smoke chamber 12 through the interruptions or cutaway portions 21*d* between the arcuate wall segments 21*c*. Openings or inlets are therefore established from the outside atmosphere to chamber 12** to allow the ingress and egress of smoke particles, while precluding the entrance of direct ambient light.

The radiation emitting means includes a light source in the form of an infrared light emitting diode (LED) 24 (see FIGS. 3 and 5) which, when energized, projects through tunnel 25 a direct and tightly focused beam of light into chamber 12. Tunnel 25 has a series of circular internal grooves for narrowing the beam angle to improve the focusing. Any light striking the grooves of tunnel 25 will bounce around and be attenuated, thereby ensuring that the light beam will be confined to a relatively small angle.

An arcuate-shaped reflector or mirror 26, preferably made of a platable plastic which is chrome plated, is mounted in the side wall portion surrounding chamber 12 and is located directly opposite to and facing the radiation emitting means o light source 24. With this arrangement, in the absence of smoke particles in chamber 12 the direct light beam from the light source will be reflected and refocused by reflector 26 back to the light source. The axes of the direct and reflected light beams will therefore essentially coincide with each other and will be parallel to the top and bottom portions of the hollow cylindrical body formed by cover 21 and base 22. The radiation sensing means is also mounted in the side wall of the body 21, 22 and comprises an infrared light responsive sensor or photodiode 28 which receives light through an aspheric lens 29 and a grooved tunnel 31, the lens and tunnel limiting the sensing means to a relatively narrow viewing angle or field.

In the absence of smoke particles entering chamber 12, the direct and reflected light beams traveling between light emitter 24 and reflector 26 will be so confined that little stray direct or reflected light will be received by light sensor 28. Note that the axes of the direct and reflected light beams are generally perpendicular to the axis of the sensing means to minimize the light inpinging on the sensor. If any stray light does reach the light sensor, its level will be compensated for during chamber calibration. This small level of stray light may then be used to supervise the integrity and stability of the light source. The key to utilizing the stray light for supervision of the light source, and further to minimize the effect of dirt and dust causing a false alarm condition, is to maintain this initial value of stray light at a constant level in the no smoke present condition. This is accomplished by the chamber construction.

Reflections of stray light off of the portion of the side wall directly opposite from the light sensor 28 is minimized by shaping that portion to provide a light trap 33 to absorb and attenuate light. Specifically, trap 33 comprises a wedge whose tapered edge **33*a* is perpendicular to the top and bottom portions of the cylindrical body 21, 22 and generally points directly toward the sensing means. With such a trap, any light entering the wedge bounces or reflects from one surface to the other and each time that occurs the light is attenuated further, the result being that no significant light will reflect toward the light sensor 28**.

Since the direct and reflected light beams passing between light source 24 and reflector 26 are restricted to a small volume, only the smoke particles lying in that volume will produce light scatter. In effect, the central area or space of smoke chamber 12 constitutes a test zone through which the direct and reflected beams are transmitted. In the event that smoke particles enter that test zone, the direct and reflected beams will strike and bounce off of those particles to produce scattered radiation which is detected by light sensor 28 to facilitate the signalling of an alarm condition. In this way, the sensor receives only the scattered light from the smoke particles within the test zone, and no stray light will reach the sensor and generate a false alarm.

It is to be noted that the light sensor 28 is located slightly more than 90° away from the light source 24. This permits the sensor to receive both forward and backward scattered light. Forward scattered light will reach the sensor in response to the direct beam from light source 24 striking the smoke in the test zone, and backward scattered light will shine on the light sensor when the reflected beam strikes the smoke particles.

A salient feature of the invention resides in the manner in which the smoke detector has been made immune to the deleterious effects of the accumulation of dirt and dust in the smoke chamber. This is achieved by providing a series of parallel V-shaped grooves on the top and bottom flat surfaces of chamber 12, grooves **21*e* being formed on, and being integral with, cover 21 (see FIGS. 4 and 5), while grooves 22*c* are formed on base 22. Dust and dirt within the chamber accumulate in the valleys of the grooves, and since the grooves 21*e* will be on the lower surface of the chamber in normal use, those grooves will usually contain most of the dust and dirt. For that reason, grooves 21***e* extend over a greater area than that covered by grooves 22*c*. Ordinarily, dust and dirt on the surfaces of a smoke chamber present good reflective surfaces from which undesired stray light may bounce and possibly reach the light sensor. However, by confining the dust and dirt to the groove valleys, as occurs with the present invention, any stray light transmitted to the grooves will first strike the valley walls before reaching the groove valleys and in the process becomes attenuated to the extent that it becomes negligible and will not impinge through lens 29 and onto light sensor 28. Moreover, the light that can enter the grooves is further inhibited due to the peaks or high ridges of the grooves. The grooves 21*e* and 22*c* are generally perpendicular to the axis of light sensor 28 so that the high ridges act as a baffle for any light. Thus, the reflectivity of the surfaces of chamber 12, with the exception of the surface formed by reflector 26, are reduced so that the only light that will be received by sensor 28 will be the scatter light that bounces off of the smoke particles in the test zone in the middle of chamber 12.

Since no stray light should ordinarily shine on the upper and lower grooved surfaces of chamber 12, the separation between those surfaces must be large enough, relative to the angles of the direct and reflected light beams traveling between light source 24 and reflector 26, that no light is transmitted to those surfaces.

While it is desired that in normal use light sensor 28 and the associated detecting circuitry respond only to the scattered light reflected off of the smoke particles in the test zone within chamber 12, the smoke detecting system is preferably constructed so that it may be calibrated and tested merely by increasing the level of the light beam substantially above its normal level. To explain, when a very high light beam emmanates from light source 24 a sufficient amount of light will fall on sensor 28 to initiate the development of an alarm condition. By increasing the level of the light beam above its normal value, the existence of smoke particles is effectively simulated to test the operation of the smoke detector. The current supplied to light source 24 may be varied to adjust the light intensity, thereby to simulate different amounts of smoke particles.

While a particular embodiment of the invention has been shown and described, modifications may be made, and it is intended in the appended claims to cover all such modifications as may fall within the true spirit and scope of the invention.

We claim:

1. An optical smoke detector comprising:

a hollow cylindrical body having generally flat and parallel top and bottom spaced-apart portions and an intermediate generally circular side wall portion, and defining a closed smoke chamber having a plurality of inlets to allow the ingress and egress of smoke particles;

radiation emitting means, mounted in the side wall portion of the cylindrical body, for projecting a direct and tightly focused beam of light into a test zone within the chamber;

a reflector, mounted in the side wall portion directly opposite to and facing the radiation emitting means, for reflecting and refocusing the light beam back through the test zone and to the emitting means in the absence of smoke particles in the test zone, the direct and reflected beams being substantially confined to said test zone away from said top, bottom and side wall portions of said body in the absence of smoke particles, and striking and bouncing off any smoke particles in that test zone to produce scattered radiation;

and radiation sensing means, mounted in the side wall portion of the cylindrical body, for detecting the scattered radiation from the smoke particles to facilitate the signalling of an alarm condition, said radiation sensing means being disposed so as not to directly receive said light beam projected by said radiation emitting means and reflected by said reflector.

2. An optical smoke detector according to claim 1 wherein the reflector is arcuate shaped, and wherein the axes of the direct and reflected light beams essentially coincide and are parallel to the top and bottom portions.

3. An optical smoke detector according to claim 2 wherein said radiation sensing means has an axis which is generally perpendicular to the axes of the direct and reflected light beams, and wherein the test zone is centrally located within the chamber.

4. An optical smoke detector according to claim 1 wherein said radiation sensing means has a lens to provide the sensing means with a relatively narrow viewing angle so that the sensing means receives primarily the scattered light from the smoke particles within the test zone.

5. An optical smoke detector according to claim 4 wherein said lens is an aspheric lens.

6. An optical smoke detector according to claim 1 wherein the side wall portion is shaped to provide a light trap in the area directly opposite to said radiation sensing means to prevent the reflection of light off of that area and toward the sensing means.

7. An optical smoke detector according to claim 6 wherein said light trap effectively absorbs light and comprises a wedge whose tapered edge is perpendicular to the top and bottom portions of the cylindrical body and generally points toward said radiation sensing means.

8. An optical smoke detector according to claim 1 wherein said radiation sensing means is located in the side wall portion slightly more than 90° away from said radiation emitting means, the sensing means receiving forward scattered light in response to the direct beam striking the smoke particles in the test zone and receiving backward scattered light in response to the reflected beam striking the smoke particles.

9. An optical smoke detector according to claim 1 wherein said radiation emitting means may be operated at a level sufficiently high to cause stray light reflected from one or more surfaces in said smoke chamber to be detected by said radiation sensing means in the absence of smoke particles, thereby permitting calibration and testing of the smoke detector.

10. An optical smoke detector comprising:

a hollow cylindrical body having generally flat and parallel top and bottom spaced-apart portions and an intermediate generally circular side wall portion, and defining a closed smoke chamber having a plurality of inlets to allow the ingress and egress of smoke particles;

radiation emitting means, mounted in the side wall portion of the cylindrical body, for projecting a direct beam of light into a test zone within the chamber, the light beam being substantially confined to said test zone away from said top, bottom and side wall portions of said body in the absence of smoke particles and, striking and bouncing off smoke particles in the test zone to produce scattered radiation;

and radiation sensing means, mounted in the side wall portion of the cylindrical body, for detecting the scattered radiation from the smoke particles to facilitate the signalling of an alarm condition, said radiation sensing means being disposed so as not to directly receive said light beam projected by said radiation emitting means, the bottom portion of the body providing a flat lower surface, in the chamber, having a series of parallel grooves for accumulating undesired dirt and dust and for minimizing the reflection of the light beam off of that dirt and dust and toward the radiation sensing means, thereby to preclude false alarms.

11. An optical smoke detector according to claim 10 wherein the axis of the light beam is generally parallel to the top and bottom portions.

12. An optical smoke detector according to claim 10 wherein the axis of the light beam is generally parallel to the grooves in the lower surface of said bottom portion of the chamber.

13. An optical smoke detector according to claim 10 wherein the grooves are V-shaped.

14. An optical smoke detector according to claim 10 wherein the top portion of the body provides a flat upper surface, parallel to the flat lower surface, having a series of parallel grooves for accumulating undesired dirt and dust in the chamber and minimizing the reflection of the light beam off of that dirt and dust and toward the radiation sensing means, thereby to preclude false alarms.

15. An optical smoke detector according to claim 1 wherein the axis of the light beam is generally parallel to the upper and lower surfaces of the chamber, and wherein the separation between those surfaces is made large enough that the light beam does not shine directly on those surfaces.

16. An optical smoke detector according to claim 10 wherein said radiation emitting means is an infrared light emitting diode, and wherein said radiation sensing means is a photodiode.

17. An optical smoke detector according to claim 10 wherein said radiation emitting means has a tunnel shaped outlet, having a series of circular internal grooves, for narrowing the beam angle and focusing the light beam.

18. An optical smoke detector according to claim 10 wherein the axis of the light beam is generally parallel to the grooves in the lower surface in the chamber, and wherein said radiation sensing means has an axis which is generally perpendicular to the light beam axis.

19. An optical smoke detector comprising:

a hollow cylindrical body having generally flat and parallel top and bottom spaced-apart portions and an intermediate generally circular side wall portion, and defining a closed smoke chamber having a plurality of inlets to allow the ingress and egress of smoke particles;

radiation emitting means, mounted in the side wall portion of the cylindrical body, for projecting a direct and tightly focused beam of light into a test zone within the chamber;

a reflector, mounted in the side wall portion directly opposite to and facing the radiation emitting means, for reflecting and refocusing the light beam back through the test zone and to the emitting means in the absence of smoke particles in the test zone, the direct and reflected beams being substantially confined to said test zone away from said top, bottom and side wall portions of said body in the absence of smoke particles, and striking and bouncing off any smoke particles in that test zone to produce scattered radiation;

and radiation sensing means, mounted in the side wall portion of the cylindrical body, for detecting the scattered radiation from the smoke particles to facilitate the signalling of an alarm, said radiation sensing means being disposed so as not to directly receive the light beam projected by said radiation emitting means and reflected by said reflector, the bottom portion of the body providing a flat lower surface in the chamber having a series of parallel grooves for accumulating undesired dirt and dust and for minimizing the reflection of the light beam off of that dirt and dust and toward the radiation sensing means, thereby to preclude false alarms.

20. A method for calibrating an optical smoke detector having a smoke chamber for receiving smoke particles, radiation emitting means for projecting a direct beam of light at a normal level into the chamber, the light beam being substantially confined to a test zone away from walls of said chamber and, striking and bouncing off of smoke particles in said test zone to produce scattered radiation, and radiation sensing means for detecting the scattered radiation to facilitate the signalling of an alarm condition, said radiation sensing means being disposed so as not to directly receive said light beam projected by said radiation emitting means comprising the step of;

increasing the level of the light beam above its normal level to the extent necessary for stray light reflected from one or more surfaces in said smoke chamber to be detected by the radiation sensing means in the absence of smoke particles in the chamber, thereby effectively simulating the existence of smoke particles to test the operation of the smoke detector.

* * * * *

UNITED STATES PATENT AND TRADEMARK OFFICE

CERTIFICATE OF CORRECTION

PATENT NO. : 4,906,978

DATED : Mar. 6, 1990

INVENTOR(S) : Best et al.

It is certified that error appears in the above-identified patent and that said Letters Patent is hereby corrected as shown below:

The title page, Item 75, add the following: --Edward K. Kaprelian, Mendham, N.J.--.

Col. 2, line 47, after "is" insert --translated--.

Col. 3, line 61, "o" should read --or--.

Col. 4, line 56, after "smoke" insert --particles--.

Col. 7, line 36, "claim 1" should read --claim 14--.

Signed and Sealed this

Twenty-third Day of April, 1991

*Attest:*

HARRY F. MANBECK, JR.

*Attesting Officer*

*Commissioner of Patents and Trademarks*